US009924779B1

(12) United States Patent
Parsons et al.

(10) Patent No.: US 9,924,779 B1
(45) Date of Patent: Mar. 27, 2018

(54) SEAT AND BACK CUSHION WITH WAIST BELT

(71) Applicants: Dale Parsons, Castle Rock, CO (US); Daniel T. Finholm, Littleton, CO (US)

(72) Inventors: Dale Parsons, Castle Rock, CO (US); Daniel T. Finholm, Littleton, CO (US)

( * ) Notice: Subject to any disclaimer, the term of this patent is extended or adjusted under 35 U.S.C. 154(b) by 0 days.

(21) Appl. No.: 15/219,482

(22) Filed: Jul. 26, 2016

Related U.S. Application Data

(60) Provisional application No. 62/198,175, filed on Jul. 29, 2015.

(51) Int. Cl.

| | |
|---|---|
| ***A45F 3/00*** | (2006.01) |
| ***A45F 4/02*** | (2006.01) |
| ***A47C 7/40*** | (2006.01) |
| ***A47C 7/02*** | (2006.01) |

(52) U.S. Cl.
CPC ..... *A45F 3/005* (2013.01); *A45F 4/02* (2013.01); *A47C 7/021* (2013.01); *A47C 7/40* (2013.01)

(58) Field of Classification Search
CPC .. A47C 9/10; A47C 7/021; A47C 7/40; A45F 3/005; A45F 4/02
USPC ..... 297/4, 452.38
See application file for complete search history.

(56) References Cited

U.S. PATENT DOCUMENTS

| | | | | | |
|---|---|---|---|---|---|
| 3,062,580 | A * | 11/1962 | Jasmin, Jr. | A45F 5/02 | 297/4 |
| 4,025,105 | A * | 5/1977 | Pekala | A47C 7/021 | 297/4 |
| 4,822,309 | A * | 4/1989 | Vandenberg | A45C 9/00 | 297/188.01 |
| 4,923,247 | A * | 5/1990 | Malmstrom | A47C 7/021 | 2/22 |
| 5,625,895 | A * | 5/1997 | Sovereign | A41D 13/0537 | 2/22 |
| 5,921,626 | A * | 7/1999 | Baker | A47C 1/16 | 297/219.1 |
| D414,914 | S * | 10/1999 | Rauterkus | D2/853 | |
| 6,010,183 | A * | 1/2000 | Perkins | A47C 4/52 | 297/4 |
| 2002/0158433 | A1* | 10/2002 | de Naurois | A47D 15/006 | 280/33.993 |
| 2013/0146636 | A1* | 6/2013 | Romero | A45F 5/021 | 224/674 |

FOREIGN PATENT DOCUMENTS

BR 200404517 A * 6/2006

* cited by examiner

*Primary Examiner* — Milton Nelson, Jr.
(74) *Attorney, Agent, or Firm* — Edwin H. Crabtree; Roman L. Pizarro

(57) ABSTRACT

A seat and back cushion for wearing by a user in a sitting, standing and walking position. The cushion includes a cushion body with a top portion attached to a waist belt. The cushion body has a shape of a human buttocks for sitting comfort. The waist belt includes quick release fasteners and buckles for length adjustment. The belt also includes two elastic sections next to opposite sides of the top portion of the cushion body. The elastic sections allow the cushion body to be lowered into a sitting position and raised into a back rest position.

1 Claim, 2 Drawing Sheets

SEAT AND BACK CUSHION WITH WAIST BELT

This non-provisional patent application claims the benefit of the subject matter and the filing date of a provisional patent application filed on Jul. 29, 2015, Ser. No. 62/198,175, having a title of "Combination Seat and Back Cushion attached to a Waist Belt", by the subject Inventors.

BACKGROUND OF THE INVENTION

(a) Field of the Invention

This invention relates to a seat cushion and a back cushion used during an outdoor or indoor sporting event and the like and more particularly, but not by way of limitation, to a combination seat and back cushion attached to a flexible, waist belt for holding the cushion next a wearer's buttocks or next to the wearer's back when sitting, standing or walking.

(b) Discussion of Prior Art

In a Great Britain published patent application, GB 19920011359, Inventor: Michael Bayley, a cushioned seat member is disclosed mounted on a waist belt. While the seat member is shown, there is no discussion or suggestion in this reference for using the seat member as a back rest nor does it have a buttock appearance with twin cheeks for comfort when sitting.

Heretofore, there have been a number of different types and styles of seat cushions for carrying to a sporting event and the like. None of these prior art cushions are designed to be attached to a waist belt. The waist belt is used for holding the cushion next to a buttocks of a cushion wearer or next to a back of the cushion wearer, for a backrest.

SUMMARY OF THE INVENTION

In view of the foregoing, it is a primary objective of the subject invention to provide a seat and back cushion attached to a flexible, adjustable, waist belt. The waist belt is received around a user's waist. The feature of the seat and back cushion attached to the waist of the user allows the user to be hands free for holding food and beverage, for holding a child, and for standing, sitting and walking during a sporting event, music event, and like outdoor and indoor events.

Another object of the invention is the cushion, when held next to a rear or buttocks of the user, can be used for adjusting to different types of seats. Also, the cushion can be quickly rotated upwardly on the waist belt and used as a back cushion or behind a coat of the user.

Still another object of the invention is the cushion has a unique appearance of a buttocks with twin cheeks. The cushion and the waist belt can be used for advertizing, and placing brand names and logos thereon.

The subject seat and back cushion includes a cushion body with a top portion attached to a waist belt. The cushion body has a shape of a human buttocks with twin cheeks. The waist belt includes quick release fasteners and buckles for length adjustment. The belt also includes two elastic sections next to opposite sides of the top portion of the cushion body. The elastic sections allow the cushion body to be lowered into a sitting position and raised for a back rest.

These and other objects of the present invention will become apparent to those familiar with different types of seat and back cushions when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

DETAINED DESCRIPTION OF THE PREFERRED EMBODIMENTS

Figure 1:
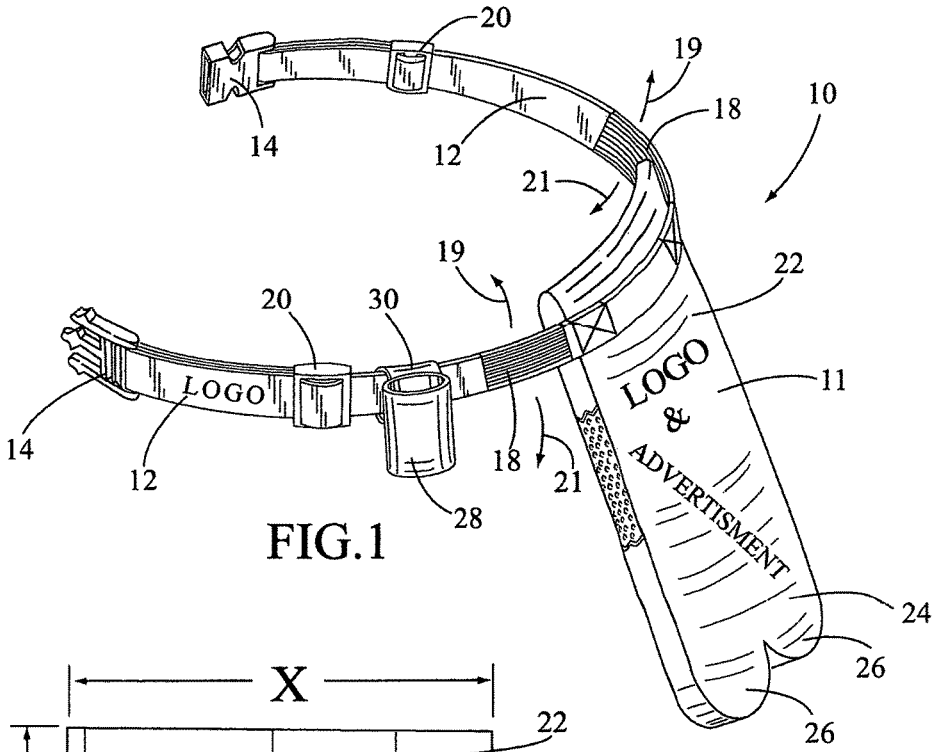
FIG. 1 is a perspective view of the seat and back cushion with waist belt.

The accompanying drawings illustrate complete preferred embodiments in the present invention according to the best modes presently devised for the practical application of the subject seat and back cushion, and in which:

In FIG. 1, a perspective view of a seat and back cushion is shown having general reference numeral 10. The cushion 10 is illustrated having a cushion body 11 attached to a waist belt 12. The waist belt 12 includes quick release fasteners 14 for securing the belt around a waist of a user 16. The user 16 is shown as a male model in FIGS. 3-5.

Figure 5:
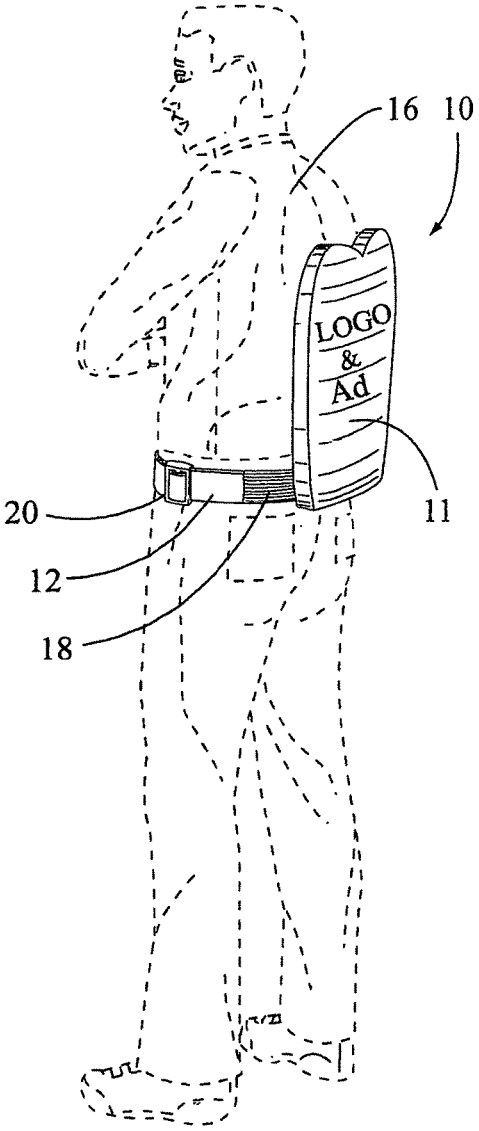
FIG. 5 illustrates a perspective view of the wearer in a standing position with the cushion disposed next to the back of the wearer.

The belt 12 also includes a pair of elastic belt sections 18 on opposite sides of a top portion 22 of the cushion body 11. The elastic belt sections 18 are used for ease in rotating the cushion body 11 upwardly, as indicated by arrows 19, and used as a back cushion, as shown in FIG. 5. Also, the elastic belt sections 18 are used to rotate the cushion body 11 downwardly, as indicated by arrows 21, and used as a seat cushion, as shown in FIG. 5. The elastic belt sections 18 are important in providing the feature of allowing the cushion body 11 to be raised and lower quickly on the belt 12, when sitting, standing and walking. Further, the waist belt 12 includes a pair of buckles 20 for adjusting length of the belt 12. It should be noted that variety of different types of quick release fasteners and buckles can be used equally well for securing the waist belt to the user and adjusting the length of the waist belt.

In this drawing, the top portion 22 of the cushion body 11 is shown attached to a portion of the belt 12. Also for added flair and comfort, a bottom portion 24 of the cushion body 11 is shown shaped into two adjacent semi-circles 26 to simulate a pair of twin cheeks of a human buttocks. Further, the bottom portion 24 of the cushion 10 can have a variety of geometric shapes without departing from the spirit and scope of the invention.

Also shown in this drawing is an accessory holder 28 with a belt loop 30. The belt loop 30 is received around a portion of the waist belt 12. The accessory holder 28 can be used for holding a cell phone, a beverage can, keys, a wallet and the like.

Figure 2:
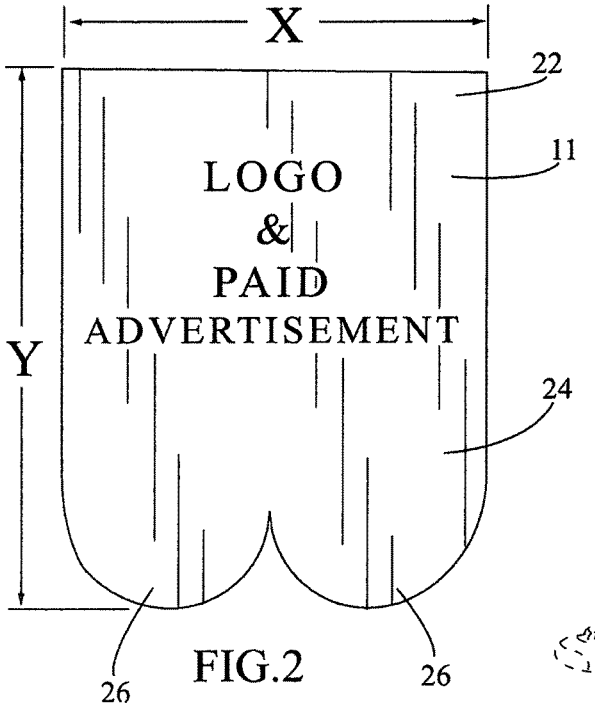
FIG. 2 is a front view of the cushion with typical width and length measurements.

In FIG. 2, a front view of the cushion body 11 is shown have a width "X" in a range of 15 to 18 inches and a length "Y" is a range of 15 to 18 inches. The cushion body can be made of a foam rubber and having a thickness in a range of ½ to 1 inch. In this drawing, the back of the cushion body 11 can include various types of advertizing, brand names and logos. Also, as shown in FIG. 1, the waist belt 12 can include advertizing, brand names and logos thereon.

Figure 3:
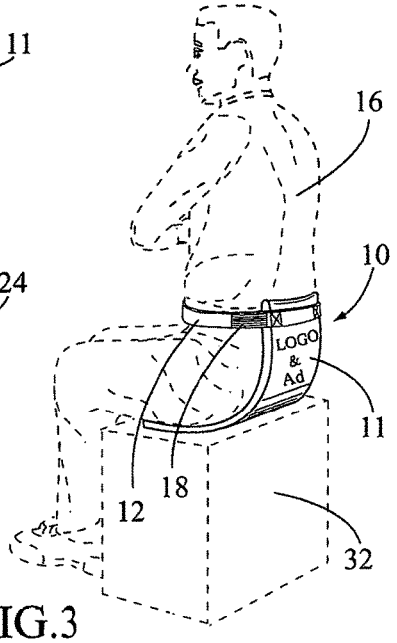
FIG. 3 illustrates a perspective view of a wearer of the seat and back cushion and sitting on a bench.

In FIG. 3, a perspective view of the male model 16 is shown sitting on the seat cushion 10 and on top of a seat 32. As mentioned above, the elastic sections 18 of the waist belt 12 allow the user of the invention to adjust the cushion to various types of seats.

Figure 4:
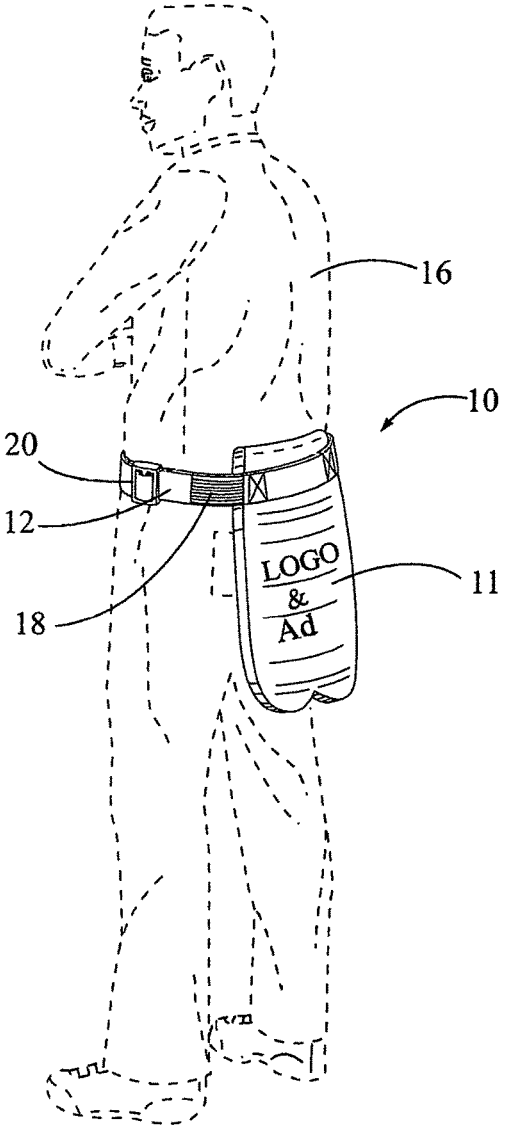
FIG. 4 illustrates a perspective view of the wearer of the seat and back cushion in a standing position with the cushion disposed next to the buttocks of the wearer.

In FIG. 4, a perspective view of the seat and back cushion 16 is shown with the cushion 10 in a lowered position on the waist belt 12 with the male model 16 in a standing position or a walking position.

In FIG. 5, a perspective view of the seat and back cushion 10 is shown received around the waist of the male model 16. In this drawing, the cushion 10 is shown, with the help of the stretching the two elastic sections 18, in a raised position on the waist belt 12 for use as a back cushion. Also, the cushion body 11 can be held in a raised position, as shown in the drawing, for standing and walking, rather than a lower position. Further and in cold weather, the cushion 10 can be held in a raised position under a coat.

As mention above, when reviewing the above drawings, it can be seen that the front and back of the cushion body 11 and the waist belt 12 can be used for advertizing a product or service, adding a team logo thereon, or adding a team color or team name.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. A seat and back cushion for wearing by a user in a sitting, standing and walking position, the cushion comprising:

a cushion body, a bottom portion of the cushion body includes two adjacent semi-circles, the cushion body made of a foam rubber material and having a thickness in a range of ½ to 1 inch, a width in a range of 15 to 18 inches, and a length in a range of 15 to 18 inches, the cushion body including advertising, logos, and brand names thereon;

a waist belt adapted for receipt around a waist of the user, the waist belt including advertising, logos, and brand names thereon;

two elastic belt sections in the waist belt and disposed on opposite sides of the cushion body, one end of the elastic belt sections attached directly to a top portion of the cushion body;

whereby the attaching of the elastic belt sections directly to the top portion of the cushion body allows the cushion body to be lowered into a sitting position and then the cushion body can be flipped upwardly allowing the cushion body to be raised in a back rest position;

quick release fasteners attached to ends of the waist belt, the fasteners for securing the waist belt around the waist of the user; and an accessory holder with belt loop, the belt loop received around a portion of the waist belt, the accessory holder adapted for holding a cell phone, beverage can, keys, and wallet.

* * * * *